United States Patent [19]

Teumer et al.

[11] 3,989,365

[45] Nov. 2, 1976

[54] MOTION COMPENSATION FOR BEAD BYPASS

[75] Inventors: Roger G. Teumer, Fairport; Earl V. Jackson, Penfield; LeRoy Baldwin, Rochester, all of N.Y.

[73] Assignee: Xerox Corporation, Stamford, Conn.

[22] Filed: June 4, 1974

[21] Appl. No.: 476,188

[52] U.S. Cl. ..... 355/3 P

[51] Int. Cl.[2] ..... G03G 15/00

[58] Field of Search ..... 204/181, 299 PE, 300 PE; 354/297, 301, 303, 318; 355/3 R, 3 P, 10, 12, 16

[56] References Cited

UNITED STATES PATENTS

| | | | |
|---|---|---|---|
| 3,551,146 | 12/1970 | Gundlach | 355/3 R X |
| 3,556,784 | 1/1971 | Robinson et al. | 355/10 X |
| 3,640,204 | 2/1972 | Gordon | 354/318 X |
| 3,697,409 | 10/1972 | Weigl | 355/3 P X |
| 3,723,288 | 3/1973 | Weigl | 204/300 PE |
| 3,761,174 | 9/1973 | Davidson | 355/16 |

*Primary Examiner*—Fred L. Braun

*Attorney, Agent, or Firm*—James J. Ralabate; Michael H. Shanahan; Charles E. Smith

[57] ABSTRACT

A system for compensating for motion during separation of a web from another surface to enable a bead of accumulated material built up at the line of contact between the web and the other surface to pass therebetween without changing the web velocity. In a preferred embodiment, the system is employed in photoelectrophoretic imaging to bypass a bead of imaging suspension built up at the imaging nip during separation of two webs immediately after completion of imaging to thereby permit dissipation or passage of the liquid bead without changing the advancing web velocity.

8 Claims, 9 Drawing Figures

MOTION COMPENSATION FOR BEAD BYPASS

BACKGROUND OF THE INVENTION

This invention relates in general to accumulated material bead bypass and web control systems and, more particularly, their use in an improved photoelectrophoretic imaging system.

In the photoelectrophoretic imaging process, monochromatic including black and white or full color images are formed through the use of photoelectrophoresis. An extensive and detailed description of the photoelectrophoretic process is found in U.S. Pat. Nos. 3,384,488 and 3,384,565 to Tulagin and Carreira; 3,383,993 to Yeh and 3,384,566 to Clark, which disclose a system where photoelectrophoretic particles migrate in image configuration providing a visual image at one or both of two electrodes between which the particles suspended within an insulating carrier is placed. The particles are electrically photosensitive and are believed to bear a net electrical charge while suspended which causes them to be attracted to one electrode and apparently undergo a net change in polarity upon exposure to activating electromagnetic radiation. The particles will migrate from one of the electrodes under the influence of an electric field through the liquid carrier to the other electrode.

The photoelectrophoretic imaging process is either monochromatic or polychromatic depending upon whether the photosensitive particles within the liquid carrier are responsive to the same or different portions of the light spectrum. A full-color polychromatic system is obtained, for example, by using cyan, magenta and yellow colored particles which are responsive to red, green and blue light respectively.

In photoelectrophoretic imaging generally, and as employed in the instant invention, the important broad teachings in the following four paragraphs should be noted.

Preferably, as taught in the four patents referred to above, the electric field across the imaging suspension is applied between electrodes having certain preferred properties, i.e., an injecting electrode and a blocking electrode, and the exposure to activating radiation occurs simultaneously with field application. However, as taught in various of the four patents referred to above and Luebbe et al. U.S. Pat. No. 3,595,770; Keller et al. U.S. Pat. No. 3,647,659 and Carreira et al. U.S. Pat. No. 3,477,934; such a wide variety of materials and modes for associating an electrical bias therewith, e.g., charged insulating webs, may serve as the electrodes, i.e., the means for applying the electric field across the imaging suspension, that opposed electrodes generally can be used; and that exposure and electric field applying steps may be sequential. In preferred embodiments herein, one electrode may be referred to as the injecting electrode and the opposite electrode as the blocking electrode. This is a preferred embodiment description. The terms blocking electrode and injecting electrode should be understood and intepreted in the context of the above comments throughout the specification and claims hereof.

It should also be noted that any suitable electrically photosensitive particle may be used. Kaprelian, U.S. Pat. Nos. 2,940,847 and Yeh, U.S. 3,681,064 discloses various electrically photosensitive particles, as do the four patents referred to above.

In a preferred mode, at least one of the electrodes is transparent, which also encompasses partial transparency that is sufficient to pass enough electromagnetic radiation to cause photoelectrophoretic imaging. However, as described in Weigl, U.S. Pat. No. 3,616,390 both electrodes may be opaque.

Preferably, the injecting electrode is grounded and the blocking electrode is biased to provide the field for imaging. However, such a wide variety of variations in how the field may be applied can be used, including grounding the blocking electrode and biasing the injecting electrode, biasing both electrodes with different bias values of the same polarity, biasing one electrode at one polarity and biasing the other at an opposite polarity of the same or different value, that just applying sufficient field for imaging can be used.

The photoelectrophoretic imaging system disclosed in the above-identified patents may utilize a wide variety of electrode configurations including a transparent flat electrode configuration for one of the electrodes, a flat plate or roller for the other electrode used in establishing the electric field across the imaging suspension.

There has been recently developed a photoelectrophoretic imaging system which utilizes web materials, which optimally may be disposable. In this process, the desired, e.g., positive image, is formed on one of the webs and another web will carry away the negative or unwanted image. The positive image can be fixed to the web upon which it is formed, or the image transferred to a suitable backing such as paper. The web which carries the negative image can be rewound and later disposed of. In such photoelectrophoretic imaging system employing disposable webs, cleaning systems are not required.

In photoelectrophoretic imaging systems employing a web device configuration, it is desirable to remove any accumulation of excess liquid build-up at the line of contact between the web and the other surface (which may be a web) to prevent bead material, at the trailing edge of an image, from flowing or otherwise extending into web areas to be used for subsequent images and thereby degrading the quality of subsequent images.

Apparatus in which surfaces including web materials are moved into and out of intimate pressure engagement for processing of film is generally known. For example, U.S. Pat. No. 3,640,204 to Gordon discloses a web processing device in which a web containing a processing ingredient or solution is brought into pressure engagement with an exposed film to effect processing of the film. This patent is not concerned with the problems overcome by the present invention, e.g., eliminating accumulation of bead material at the line of contact between the web and surface.

A process for removing excess liquid developer from a photoconductive surface is the Pneumatic Assembly Liquid Removing method and apparatus disclosed by Smith et al. in U.S. Pat. No. 3,741,643. In this pneumatic assembly liquid removing process, a system is provided wherein excess toner is removed from the photoconductive surface by means of apparatus that requires equipment that is expensive and complex in comparison with the instant invention.

In Mihajlov, U.S. Pat. No. 3,281,241, a bead of developer liquid is advanced across the surface of the imaging support member. There is no suggestion, however, for employing the techniques of the instant invention.

In earlier photoelectrophoretic apparatus which sometimes encounters this bead of accumulated material, Egnaczak, U.S. Pat. Nos. 3,673,632 and Riley, 3,686,035 provide a slot in one of the surface to collect a bead, the slot being periodically emptied, to solve a similar problem. However, it may be impossible or impractical to employ a similar arrangement when using relatively thin webs as the surfaces.

One system that provides a simple and economical method and apparatus to eliminate this tailing liquid problem, without the above noted disadvantages, is disclosed in the copending application Ser. No. 476,189 entitled Bead Bypass by Herman A. Hermanson, filed on the same date and assigned to a common assignee. In this system, apparatus is employed to separate two surfaces to a spacing sufficient to allow accumulated bead material formed at the line of contact between the surfaces to pass therebetween. However, when separation occurs, there may be a change in web velocity due to corresponding changes in web length. This change in web velocity or web length may be reflected at other process steps that are being carried out contemporaneously in the system.

SUMMARY OF THE INVENTION

Accordingly, it is an object of this invention to remove accumulations of materials between moving surfaces without the above noted disadvantages.

Another object of this invention is to improve cleaning techniques and means for the development of images of imaging systems.

A further object of this invention is to improve systems for removing accumulations of materials between two members moving relative to each other cyclically and automatically.

Still another object of this invention is to prevent or eliminate accumulations of materials from interfering with further images of an imaging system.

Another object of this invention is to improve photoelectrophoretic imaging systems employing a web device by eliminating image defects caused by accumulation of excess liquid beads, at the line of contact between electrodes.

Yet another object is to provide a photoelectrophoretic web imaging system using a minimum amount of web material.

Yet another object of this invention is to permit bead bypass by separating or nearly separating two surfaces, one of which is a web, without changing the advancing velocity of said web during the separating or recontacting operation to permit, e.g., said web to be advanced at a constant velocity so that processing steps either prior to or subsequent to the separation and recontacting operation are not adversely affected.

Yet another object is to provide a bead bypass system with a minimum amount of advancing surface by slowing or stopping at least one surface during the actual bead bypass which occurs when the surfaces are separated or approaching separation. In some modes and for some uses of the instant invention, both surfaces may be slowed down or stopped when the surfaces are separated.

The foregoing objects and others are accomplished in accordance with this invention by a system for compensating for motion during separation of a web from another surface to enable a bead of accumulated material built up at the line of contact between the web and the other surface to pass therebetween without changing the web velocity. In a preferred embodiment, the system is employed in photoelectrophoretic imaging to bypass a bead of imaging suspension built up at the imaging nip during separation of two webs immediately after completion of imaging to thereby permit dissipation or passage of the liquid bead without changing the advancing web velocity.

DESCRIPTION OF THE DRAWINGS

These and other objects and advantages of motion compensating bead bypass systems and their use in improved photoelectrophoretic imaging systems will become apparent to those skilled in the art after reading the following detailed description taken in conjunction with the accompanying drawings wherein.

DESCRIPTION OF THE PREFERRED EMBODIMENTS

The invention, herein, is described and illustrated in specific embodiments having specific components listed for carrying out the functions of the apparatus. Nevertheless, the invention need not be thought of as being confined to such specific showings and should be constructed broadly within the scope of the claims. Any and all equivalent structures and methods known by those skilled in the art can be substituted for the specific apparatus and methods disclosed as long as the substituted method and apparatus achieve a similar function. It may be that other methods and apparatus would be invented having similar needs to those fulfilled by the method and apparatus described and claimed herein, and it is the intention herein to describe an invention for use in apparatus other than the embodiment shown. For example, the invention hereof can be used in apparatus comprising a web in contact with a plate surface or any system wherein it is desirable to separate a web from contact with another surface to allow for the dissipation of a bead of accumulated material built up at the line of contact between the web and the surface.

MOTION COMPENSATING BEAD BYPASS SYSTEM

Figure 1:
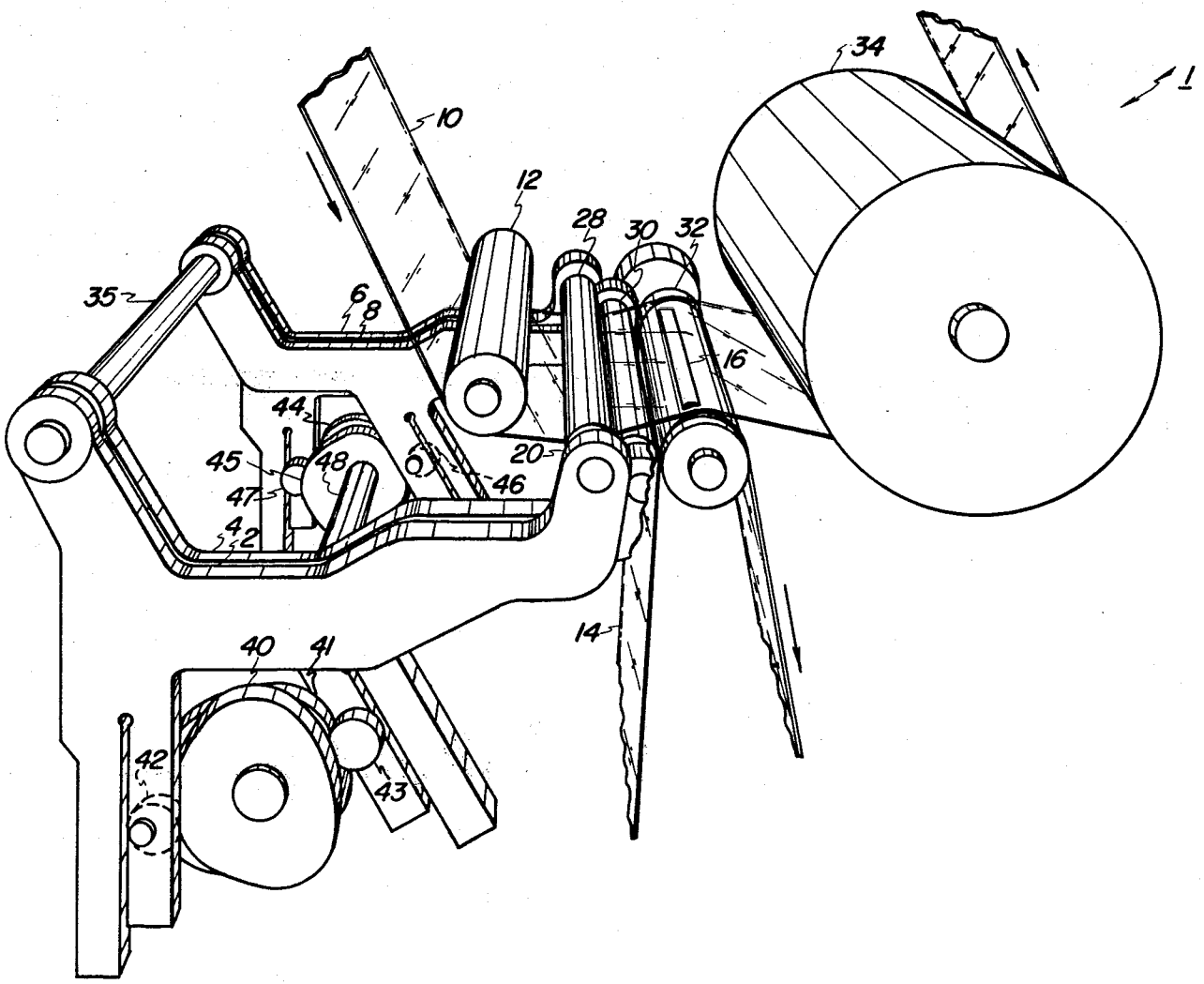
FIG. 1 is a side view, pictorial drawing of a preferred embodiment of the motion compensating bead bypass system according to this invention employed in a portion of a photoelectrophoretic imaging apparatus.

Referring now to the FIG. 1 and 2 embodiment of the invention, there is shown a pictorial drawing of a preferred embodiment of the motion compensating bead bypass system according to this invention. The motion compensating bead bypass system, generally designated as 1, includes the pressure roller 28 and the separator roller 30. The pressure roller 28 is rotatably mounted between the outside front lifter 2 and the outside rear lifter 6, respectively. The separator roller 30 is rotatably mounted between the inside front lifter 4 and the inside rear lifter 8, respectively. The outside lifters 2 and 6 are pivotally attached to the pivot rod 35. Likewise, the inside lifters 4 and 8 are pivotally attached to the pivot rod 35. The cam followers 42 and 47 are mounted on the inside of the lifter 2 and on the inside of lifter 6, respectively. The cam follower 42 aligns with and cooperates with the cam 40 that is carried on the shaft 48, and the cam follower 47 aligns with and cooperates with the cam 44 which is also carried on the shaft 48, for a camming application to be described in detail hereinafter.

The cam followers 43 and 46 are mounted on the outside of the lifter 4 and on the outside of the lifter 8, respectively. The cam follower 43 aligns with and cooperates with the cam 41 that is carried on the shaft 48, for a camming application to be described later. Likewise, the cam follower 46 aligns with and cooperates with the cam 45 that is also carried on the shaft 48.

The web 14, referred to as the blocking web, is formed of an about 1 mil clear polypropylene blocking electrode material. Although a web is preferred as the blocking electrode in this invention, the blocking web may also take the form of a drum, a flat surface or a reusable endless belt blocking electrode. The web 10, referred to as the injecting web, is formed of an about 1 mil Mylar, a polyethylene terephthalate polyester film from DuPont, overcoated with a thin transparent conductive material, e.g., about 50 per cent white light transmissive layer of aluminum. The conductive surface of the injecting web 10 is connected to ground 38 at some convenient location within the system. As will be made clear from the explanation that will be given below, by analogy, the functions of the injecting web and the blocking web correspond to the functions of the injecting and blocking electrodes, respectively, described in great detail in the four patents referenced earlier.

When the motion compensating system 1 is employed in photoelectrophoretic imaging apparatus, when the system is not in operation or is at rest, the injecting web 10 and blocking web 14 are separated from each other in the retracted position. At the start of the imaging cycle, the injecting web 10 is driven in the direction of the arrow by a mechanical drive 58 which accelerates web 10 to a constant speed between 3 – 20 inches per second, preferably about 5 inches per second, and the blocking web 14 is driven by an independent drive 57 in the direction of the arrow at a constant speed to match the speed of the injecting web 10 (see FIGS. 2A–2C). The outside surface of the blocking web 14 is entrained around the imaging roller 32 and the outside surface of the web 10 is entrained around the roller 12 and 28 and around the drive capstan 34. The inside surface of the web 10 is initially entrained around the roller 30 which urges the web 10 away from contact with the web 14 and at the desired time, the separator roller 30 and the pressure roller 28 are moved downward bringing the webs into contact forming a nip at the imaging roller 32. During the contacting sequence, the rollers 28 and 30 are caused to move in an arcuate downward direction in a controlled manner whereby the advancing rate of velocity for the injecting web 10 remains constant. Likewise, during the separating sequence, the rollers 28 and 30 are moved in an arcuate upward path in a controlled manner so that the advancing rate of velocity for the injecting web 10 remains constant during separation. The separator roller 30 initiates upward movement prior to the initiation of upward movement of the pressure roller 28 and the pressure roller 28 does not initiate its upward movement until the separator roller 30 has just made contact with the inside surface of the injecting web 10. Each roller terminates its upward movement at the same time.

PHOTOELECTROPHORETIC IMAGING SYSTEM

Figure 2A:
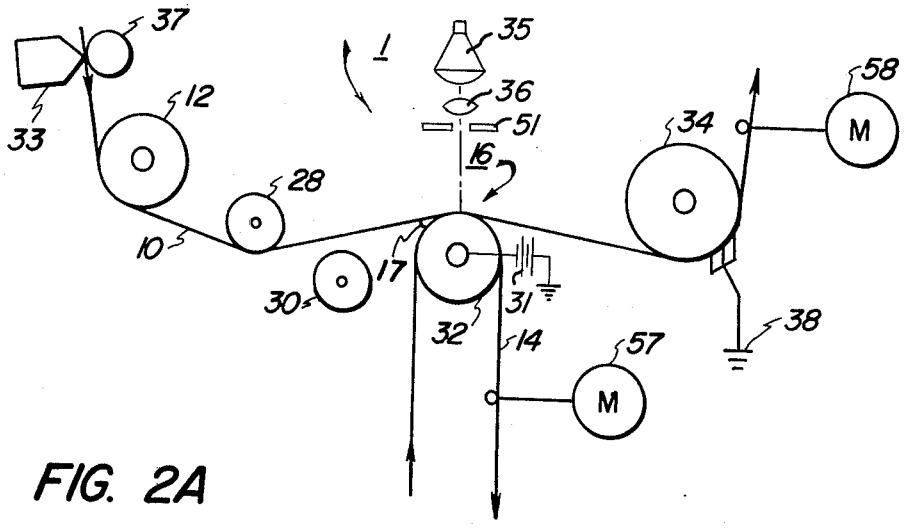
FIGS. 2A–2C are side view, schematic drawings of a portion of a photoelectrophoretic imaging apparatus for illustrating operation of this invention.
Figure 2B:
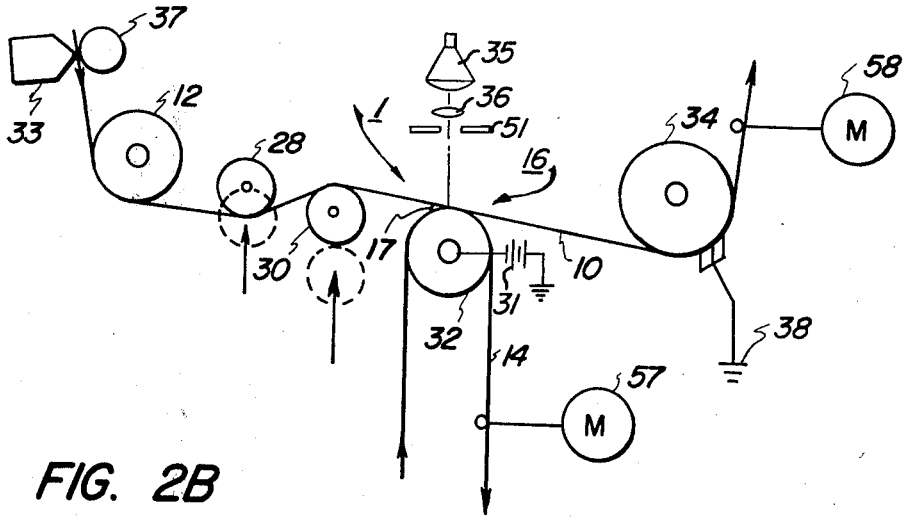
Figure 2C:
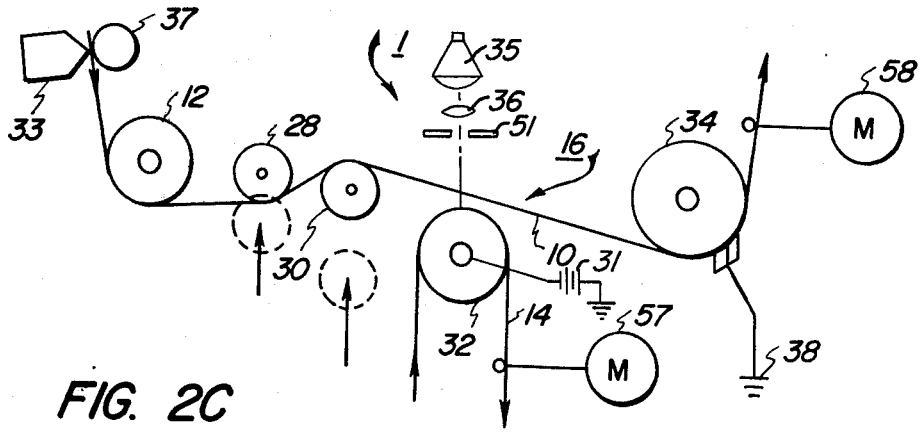

Referring now to FIGS. 2A–2C, there is shown a side view, schematic drawing of a portion of a web configuration photoelectrophoretic imaging system for illustrating the operation of the motion compensating bead bypass system 1. There are problems attendant to the use of the web configuration in photoelectrophoretic imaging systems, some of which the present invention is designed to solve. The actual process steps of the web device configuration are basically the same process steps as used in photoelectrophoretic imaging systems described in patents referred to earlier and are incorporated by reference herein. The present description will be directed in particular to elements forming part of, or cooperating more directly with the present invention, elements of the photoelectrophoretic apparatus not specifically shown or described herein being understood to be selectable from those known in the art.

The web device inking system includes the applicator 33 and a rigidly supported backup inking roller 37 mounted for rotation. The applicator 33 supplies a metered flow of ink that will provide a uniform ink coating of the desired thickness on the conductive side of the injecting web 10. In one instance, an about 14 inch film length ink layer is coated onto the injecting web 10 at about 1.25 mils ink film thickness.

When the two webs are brought together and the layer of ink film reaches the imaging zone 16 to form the ink-web sandwich, the imaging roller 32, which may be formed, for example, of steel or conductive rubber, may be utilized to apply a uniform electrical imaging field across the ink-web sandwich. The combination of the pressure exerted by the tension of the injecting web and the electrical field across the ink-web sandwich at the imaging roller 32 tends to restrict passage of the liquid suspension, forming a liquid bead 17 at the inlet to the imaging nip. This bead will remain in the inlet to the nip after the coated portion of the web has passed, and will then gradually dissipate through the nip. If a portion of the bead remains in the nip until the subsequent ink film arrives, it will mix with this film and degrade the subsequent images. One method for avoiding the degrading of images from this effect would be to allow lengths of web materials, not coated with suspension, to pass through the imaging zone, after liquid bead build up, sufficient to allow all traces of liquid to pass before an imaging sequence is repeated. This method would entail a time delay between images and would also result in a great deal of waste of web material. An improved method for avoiding this degrading of images is described in copending application Ser. No. 476,189, entitled Bead Bypass by Herman A. Hermanson, as noted hereinabove, wherein apparatus is employed to separate two surfaces momentarily immediately after completion of imaging to permit the passage of the liquid bead between image frames. In one mode, separation of a web from a surface is accomplished by disengaging the movable web from the surface, which may tend to interrupt or change the surface velocity of the web. Now, in the case of some photoelectrophoretic imaging systems, wherein process steps are carried out simultaneously or in a timed sequence, interference with web surface velocity or length would be undesirable.

The instant invention provides a simple and economical method and apparatus to eliminate the accumulated bead problem, without the above noted disadvantages. In a preferred embodiment, the motion compensating bead bypass system 1 functions to separate the two webs 10 and 14, having liquid suspension sandwiched between them to allow the liquid bead formed at the line of contact between the webs to pass therebetween beyond the imaging areas between frames without changing web velocity. After the webs 10 and 14 have been moved into contact with each other at the nip, imaging suspension sandwiched therebetween, the separation of webs 10 and 14 may be obtained at the desired time by the use of the cam bank, mentioned hereinearlier. As seen in FIG. 2B, during the separation sequence, both the pressure roller 28 and the separator roller 30 move upward from the position shown in dotted line in the direction of the arrows. The separator roller 30 begins its movement prior to movement of the pressure roller 28, and the pressure roller 28 does not begin its movement until the separator roller 30 has contacted the inside surface of the injecting web 10. It should be apparent that the separation sequence is the reverse of the sequence that takes place during the contacting of the webs at the start of the imaging cycle and that motion compensation is obtained both during separation and contacting of the webs. When the separator roller 30 engages the injecting web 10, as the wrap angle, e.g., that angle formed by the web 10 around the roller 32, is decreased, the normal force due to web tension or pressure between the webs is reduced and the liquid bead, formed at the line of contact between the webs at the entrance to the nip, begins to gradually dissipate through the nip. Now as the wrap angle approaches 0°, that is when the gap is such that the webs are just tangent with each other or actual separation is obtained, the bead is quickly or immediately passed through the nip allowing all traces of any liquid beads carried on the webs to pass through the nip beyond the image zone 16.

Referring now to the FIG. 2C phase of the bead bypass operation, the pressure and separator rollers 28 and 30, respectively, are shown at positions obtained at the completion of their upward most movement. In this illustration, the injecting web 10 is shown as having been disengaged from contact with the blocking web 14 at the nip, thus allowing the excess liquid bead, formed at the entrance to the nip, to pass beyond the imaging zone. The movement of the separator roller 30 is controlled and coordinated with the ink application so that it contacts only uncoated portions of the web 10 when it engages the inside surface of the web 10.

The pressure roller 28 and capstan roller 34 are spaced apart from each other sufficiently to permit exposure to be made in the imaging zone 16 through transparent injecting web 10 without obstructing projected rays of illumination. During separation, the length of the conductive web 10, between the guide roller 12 and capstan roller 34, does not change primarily due to the coordinated upward motion of the pressure and separator rollers which compensate for any slack or jerky motion that might otherwise occur. This compensation motion is also provided in a reverse sequence during the return or downward direction of the pressure and separator rollers. Thus, the web 10 length does not change and the advancing rate of velocity for web 10 remains constant during the separation and the contacting of the webs and this is important to other process steps within the system which may be occurring simultaneously or in a timed sequence.

CAMMING APPLICATION

Reference is now made to FIGS. 3A–3D, which illustrate the camming application according to this invention. This illustration is directed to the cam bank arrangement associated with the outside front lifter 2 and the inside front lifter 4, and it is understood that this explanation also applies to the cam bank arrangement associated with the rear lifters 6 and 8 since they are identical to the front lifters. The cams 40 and 41 are mounted to the shaft 48, which in this example, by the keyed sleeve coupling, indicated as 49. The cam bank, consisting of cams 40 and 41, are arranged on the shaft 48 in a manner to obtain the desired phase relationship. As you will recall, the phase relationship for the cams is such that the separator roller 30 initiates its movement prior to movement of the pressure roller 28. Also, the outer radius of cam 41, which is associated with movement of the separator roller 30, is slightly greater than the outer radius of cam 40, thereby resulting in a greater length of movement for the separator roller 30 than for the pressure roller 28.

Figure 3A:
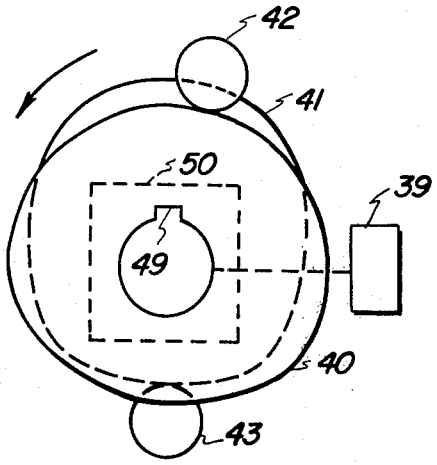
FIGS. 3A–3D are side view, schematic drawings for illustrating a detail of the camming application according to this invention.

Referring now to FIG. 3A, the upward and downward motions for the pressure roller 28 and separator roller 30 are controlled by the cams 40 and 41 in cooperation with the cam followers 42 and 43, respectively. The shaft 48, which carries the cams 40 and 41, is rotated in the direction of the arrow at a constant velocity by the mechanical drive 50. The orientation of the cams on the shaft and their particular geometric shapes determines the web separation and contacting sequence. For example, FIG. 3A illustrates the situation where the pressure roller 28 and the separator roller 30 are in the imaging position, downward motion has been completed and the webs 10 and 14 are in contact with each other, imaging suspension sandwiched between them, which also corresponds to the illustration of FIG. 2A. The ink-web sandwich has been formed and set for the application of electrical imaging field.

Initiation of the camming action is provided by the control means 39 which cooperates with the constant speed A.C. motor 50 to rotate the shaft 48 which carries the cam bank, cams 40 and 41 at the desired rate of speed. For example, in the case when the webs are advanced at the rate of 5 inches per second, the camming cycle may be set at about one cycle per second by the control means 39. Therefore, during one complete cycle of bead bypass (e.g., period from beginning to end of webs opening and closing), at least about 5 inches of web advances through the imaging zone.

The camming cycle is adjustable by the control means 39 and is in phase with imaging cycle. In this regard, web separation is begun just upon completion of the application of imaging field and the next field applied coincides with the reforming of the ink-web sandwich at the imaging zone and exposure. It will also be appreciated that during the separation period, when the webs are out of contact, ink application is timed such that those web portions traveling through the imaging zone 16 are devoid of ink.

Figure 3B:
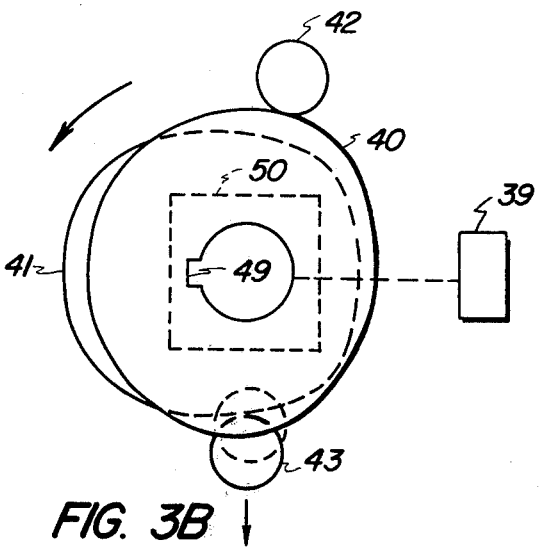

The FIG. 3B illustrates the phase relationship of the cams 40 and 41 with the cam followers 42 and 43, respectively, rotated 90° from the imaging position. It should be noted that in this illustration, the lobe portion of the cam 41 mating with the cam follower 43, has already initiated movement of the cam follower 43 from the dotted line position in the direction of the arrow, thereby transmitting an upward motion to the separator roller 30. The pressure roller 28, moved by motion transmitted from the cam follower 42, has not moved from the imaging position. The FIG. 3B illustration, by way of example, depicts the phase of operation of the motion compensating bead bypass system which may correspond to FIG. 2B.

Figure 3C:
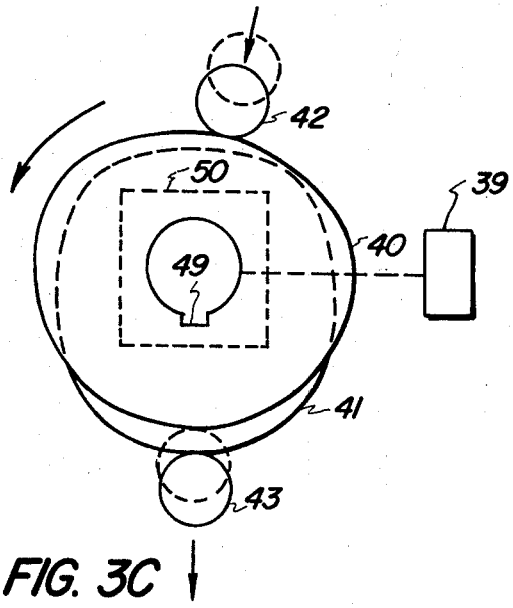

Turning now to FIG. 3C, there is illustrated the camming application during 180° rotation of the cam bank from the normal position. In this case, upward motion has been completed for both the pressure roller 28 and the separator roller 30, and may correspond to the illustration of FIG. 2C, wherein actual separation of the webs has been obtained. FIG. 3C, therefore, is the reverse situation of FIG. 3A.

Figure 3D:
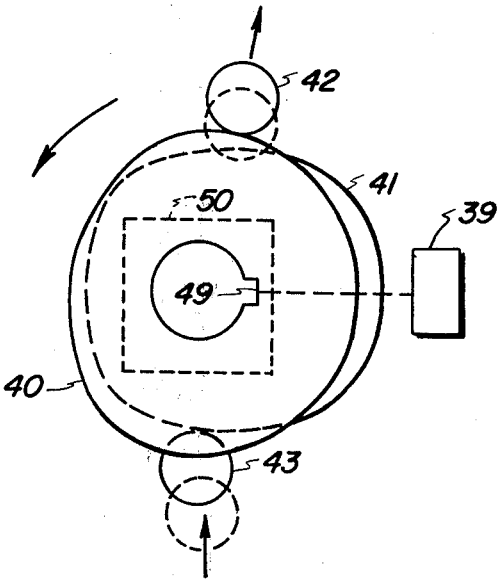

With regard to the FIG. 3D phase of the invention, this illustration depicts the camming application during 270° rotation of the cam bank from the normal position. This illustration may correspond to the period during web separation when the injecting or conductive web 10 begins to return to the imaging position. FIG. 3D would represent the reverse camming application from that of FIG. 3B.

The techniques that have been described herein for the application of the motion compensating bead bypass system in photoelectrophoretic imaging apparatus for the dissipation of accumulated material from the entrance nip in the imaging zone, may also be utilized in a similar fashion in the photoelectrophoretic transfer zone. In one exemplary example, the image formed on the surface of the injecting web 10 is carried into contact with copy web material entrained around the transfer roller at the transfer zone. When the injecting web 10, which carries the formed image, is moved into pressure contact with the copy web at the transfer roller, excess liquid material may build up at the line of contact between the injecting web 10 and the copy web. It should become apparent that motion compensating bead bypass apparatus, described hereinearlier with regard to the photoelectrophoretic imaging zone, may also be utilized in connection with the transfer step to dissipate the bead of accumulated material without changing the advancing rate of velocity of the injecting web.

IN OPERATION

One example of the apparatus, hereof, in operation is as follows:

At the start of the photoelectrophoretic imaging cycle, the injecting web is accelerated to a constant speed of about 5 inches per second and the blocking web is driven at a constant speed to match the speed of the injecting web. The blocking web is entrained around the imaging roller and the injecting web is entrained around guide rollers and is initially entrained around the separator roller which urges the injecting web away from contact with the blocking web. The ink applicator provides a uniform ink coating of photoelectrophoretic imaging suspension on the conductive side of the injecting web. The photoelectrophoretic ink or imaging suspension is any suitable photoresponsive particle in an insulating carrier liquid and may, for example, comprise the imaging suspension described in the aforementioned U.S. Pat. No. 3,384,488. An ink film segment, approximately 1.25 mils thick and about 14 inches long in the longitudinal direction of the web is coated onto the injecting web. At the desired time, the separator roller and the pressure roller are moved downward, starting their movement at the same time, by camming apparatus bringing the webs into contact forming a nip at the imaging roller. The two webs are brought together at the imaging roller at about the same time the layer of ink film reaches the imaging zone to form the ink-web sandwich and the imaging roller is utilized to apply a uniform electrical imaging field across the ink-web sandwich. A voltage of approximately −2500 volts is applied to the core of the imaging roller from voltage source 31 while simultaneously projecting a light image of a full color transparency onto the interface of the nip. Exposure is effected by exposure means comprising in this illustrative instance light source 35, lens 36 and a slit 51. During the contracting sequence, the pressure roller and the separator roller are caused to move in an arcuate path downward in a controlled manner whereby the advancing rate of velocity for the injecting web remains constant. Roller 30 is then to be moved out of contact with the surface of the injecting web to avoid the contact of roller 30 with the inked portion of the injecting web. This controlled sequence during contacting of the webs compensates for any slack or jerky motion that might otherwise occur on the injecting web. If the combination of the pressure exerted by the tension of the injecting web and the electrical field across the ink-web sandwich at the imaging roller causes excess liquid suspension to be uniformly metered out of the sandwich upon completion of the imaging cycle, the pressure and separator rollers are cammed in an arcuate upward path in a controlled manner to separate the webs to a spacing sufficient to allow all traces to pass beyond the imaging zone. The motion compensating bypass system insures that during the separating sequence, the advancing rate of the injecting web remains constant. During separation, the separator roller begins its upward movement prior to the upward movement of the pressure roller, and the pressure roller does not being movement until the separator roller has contacted the inside surface of the injecting web. When the separator roller engages the injecting web surface and as the wrap angle is decreased, web tension is reduced and the liquid bead begins to gradually dissipate through the nip. As the wrap angle approaches 0° or when actual separation is obtained, all traces of the bead are quickly dissipated through the nip. The rate of dissipation in both cases depends upon the gap and velocity of the webs. The rate of dissipation also depends upon the normal forces and the internal pressure of the liquid. When the wrap angle is reduced to approaching 0° wrap, when this condition exists, the normal forces are removed and the liquid bead at the inlet to the nip is quickly dissipated through the nip, the rate of dissipation determined primarily by the gap and velocity of the webs.

The upward and downward motions of the pressure and separator rollers are controlled by means of the bank of cams cooperating with the cam followers. The separator and pressure rollers, both 0.500 inches in diameter, are caused to be displaced arcuate distances of 0.750 and 0.328 inches, respectively, center-to-center, during one complete cycle of bead bypass. Initiation of the camming action is provided by the control means which operates the constant speed motor to rotate the shaft which carries the cam bank. The movement of the pressure and separator rollers, thus, separation and contacting of the webs, is controlled and coordinated with the ink application so that the separator roller contacts only uncoated portions of the injecting web. Also, web separation begins upon completion of the application of imaging field after the ink film passes the imaging zone and the next field applied coincides with the re-contacting and re-forming of the ink-web sandwich at the imaging zone and exposure.

During the period when the webs are separated out of contact with each other, the advancing velocity of the injecting web remains constant and the velocity of the blocking web may be shifted from the imaging zone to a reduced standby mode or stopped automatically in order to conserve blocking web material. The advancing rate of the blocking web may be reduced to variable speeds or stopped between imaging frames during continuous operation and during non-continuous operation, the blocking web may be stopped completely during the period when the webs are out of contact with each other at the nip in the imaging zone. As the separator roller begins to move upward to separate the webs, the arm or lifter which mounts the roller, automatically actuates a micro-switch abutting the arm as the arm begins to move as a result of the camming action. When the photoelectrophoretic imaging device is operated continuously, i.e., to reproduce a series of images, the micro-switch is coupled to a variable potentiometer which in conjunction with control means decreases the level of the magnitude of voltage supplied to the blocking web drive motor when the webs are separated thereby reducing the advancing rate of the blocking web to a standby speed or stopping it, and increases the amount of voltage when the webs are brought into contact so that the blocking web is advanced at the imaging or process speed. Alternatively, a cam bank logic control means may be used to automatically reduce the advancing rate of the blocking web when the webs are out of contact with each other. In the case when the photoelectrophoretic imaging device is operated non-continuously, i.e., a single image is reproduced, the micro-switch is coupled to the blocking web drive supply and when actuated turns off the power supplied to the blocking web drive thereby stopping the blocking web completely.

After the ink-web sandwich has been subjected to the electrical field, exposed and the web separation sequence completed, the positive image is formed on the injecting web and the negative image is formed on the blocking web. The blocking web, which carries the negative image, may be rewound onto the take-up reel and disposed of. The injecting web, which carries the formed positive image, is carried into contact with a copy web entrained around the transfer roller at the transfer zone. Once the image has been transferred to the copy web, additional motion compensating bead bypass apparatus, identical to that used in the imaging zone, is utilized to separate the injecting web from the copy web to allow any excess liquid bead material that may build up at the line of contact between the webs to dissipate. During the transfer process motion compensating bead bypass apparatus functions in the same manner as in the imaging zone so that during the separation and the contacting of the webs at the transfer zone, the advancing rate of velocity of the webs at the transfer zone remains constant.

Thus, the originally projected image is substantially reproduced on the copy web without defects that may be caused by the accumulation of excess liquid material at the photoelectrophoretic imaging and transfer nip.

Figure 4:
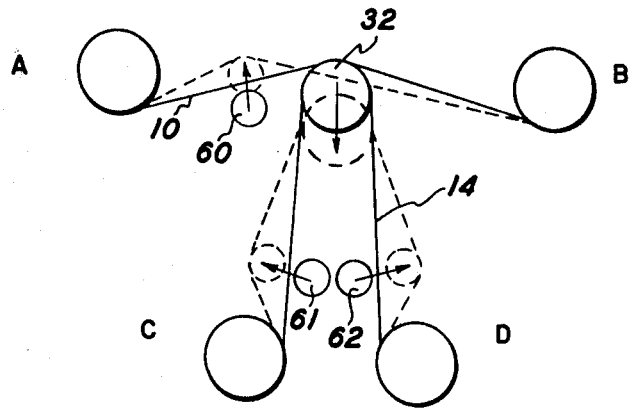
FIG. 4 is a drawing of an alternative embodiment of the invention.

FIG. 4 is an alternative embodiment of this invention. In this embodiment, for web separation, the imaging roller 32 is moved downward as shown by the arrow, to the position indicated by dotted line. The compensation roller 60 is moved upward at the same time to thereby maintain a taut condition in the web 10. Also, in order to maintain a taut condition in the web 14 (and to meet the condition of no relative slip between webs when they are in contact), the rollers 61 and 62 which move generally in the direction of the arrows, are provided. Both the path and the velocity characteristics of the motion of the imaging roller 32 may be arbitrarily determined. The paths of motion of the rollers 60, 61 and 62 may also be arbitrarily determined, however, the velocity characteristics of the motions of these three rollers must be coordinated with each other and must be strictly controlled in timed relation to the motion of the imaging roller 32. Although roller motion and movement have been mentioned generally in this alternative embodiment, it will be appreciated that the apparatus and elements described hereinearlier with regard to FIGS. 1–3 may be utilized herein in a similar manner.

Other modifications of the above-described invention will become apparent to those skilled in the art and are intended to be incorporated herein.

What is claimed is:

1. Apparatus for photoelectrophoretic imaging comprising a. means for removing a bead of accumulated photoelectrophoretic imaging suspension of electrically photosensitive particles in a carrier liquid from the entrance of a nip region formed between two webs, each of said webs having inside and outside surfaces with respect to the nip, wherein successive portions of the inside surfaces of said webs move into contact with each other to form the nip comprising i. means for advancing said successive portions of each web into contact with each other at the nip including means to advance each web relative to the nip region so that any bead portions carried on the inside surfaces are advanced beyond the nip region when the webs are separated from contacting engagement with each other; and ii. means for separating the webs at the nip to a spacing sufficient to allow a bead of accumulated photoelectrophoretic imaging suspension to pass the nip region, wherein said separating means includes motion compensating means for automatically compensating for motion during separation whereby the advancing rate of velocity of the webs remains constant;

b. means for coating a photoelectrophoretic imaging suspension on successive portions of the inside surface of at least one of said webs before being brought into contact with the inside surface of the other web at the nip, said suspension being sandwiched between the inside surfaces of the webs at the nip;

c. means for applying an electrical field across said imaging suspension at least when said webs are in contact at the nip with the imaging suspension therebetween; and d. means for imagewise exposing said suspension at the nip to an image of activating electromagnetic radiation at least when said webs are in contact at the nip with the imaging suspension therebetween.

2. Apparatus according to claim 1 wherein one of the webs is transparent and is an injecting electrode and the other web is a blocking electrode.

3. Apparatus according to claim 1 wherein at least one of said webs is transparent and wherein said imagewise exposure is through said transparent web.

4. Apparatus according to claim 3 wherein the nip is formed by a first roller supporting the outside surface of a first one of said webs with second and third rollers supporting the outside surface of the second one of said webs and a fourth roller movably mounted for supporting the outside surface of the second web, the second and fourth rollers being located prior to the nip in the direction of advancement of the second web and the third roller being located after the nip in the direction of advancement of the second web.

5. Apparatus according to claim 4 wherein the second web is transparent and the imagewise exposure to activating radiation is from the outside surface of said second web.

6. Apparatus according to claim 5 wherein said web separating means includes camming means for disengaging and contacting of the webs at the nip and compensating for motion whereby the advancing rate of velocity of the webs remains constant.

7. Apparatus according to claim 6 wherein said camming means comprises in combination:

a. a cam bank rotatably mounted on a common shaft, said second and fourth rollers being displaceable by said cam bank;

b. drive means for rotating said cams in synchronism;

c. cam followers in contact with said cams for transmitting rotary motion of said cams;

d. lifters connected between said cam followers and said second and fourth rollers to impart reciprocating motion transmitted from said cams to said second and fourth rollers; and e. control means for initiating camming action and thereby web disengagement and the contacting of the webs at the nips in phase with turn-off and application of the electrical field, respectively.

8. Apparatus according to claim 5 wherein a film of said suspension is coated on a segment of said second web said film being about 14 inches in length in the longitudinal direction of the web and said electrical field application is cycled for application and turn-off for each of said coated segments traveling through the nip.

* * * * *